US005245769A

United States Patent [19]

Wammock

[11] Patent Number: 5,245,769

[45] Date of Patent: Sep. 21, 1993

[54] TRENCHER FOR MOUNTING ON A TRACTOR

[76] Inventor: Johnny E. Wammock, Rte. 2, Box 50, Warrenville, S.C. 29851

[21] Appl. No.: 977,686

[22] Filed: Nov. 18, 1992

[51] Int. Cl.[5] ..... E02F 5/06; F16H 37/06

[52] U.S. Cl. ..... 37/357; 37/355; 37/353; 37/347; 37/362; 37/464; 74/665 Q

[58] Field of Search ..... 37/86, 87, 83, 85, 80 R, 37/DIG. 17, 191 A, 191 R, 192 A; 74/665 Q, 670; 474/138; 414/718

[56] References Cited

U.S. PATENT DOCUMENTS

| | | | |
|---|---|---|---|
| 765,785 | 7/1904 | Nelson . | |
| 953,226 | 3/1910 | Pontius . | |
| 2,548,182 | 4/1951 | Wagner . | |
| 2,692,466 | 10/1954 | Smith . | |
| 2,935,801 | 5/1960 | Stewart, II et al. . | |
| 2,981,012 | 4/1961 | Meyer . | |
| 3,044,194 | 7/1962 | Balkheimer . | |
| 3,050,881 | 8/1962 | Brown . | |
| 3,130,506 | 4/1964 | Laster . | |
| 3,206,876 | 9/1965 | Penote . | |
| 3,209,473 | 10/1965 | Davis . | |
| 3,593,590 | 3/1970 | Kesl et al. . | |
| 3,623,246 | 11/1971 | Skomial et al. . | |
| 3,834,049 | 9/1974 | Bond . | |
| 4,427,075 | 1/1984 | Romes . | |
| 4,508,178 | 4/1985 | Cowell et al. . | |
| 4,827,636 | 5/1989 | Emming | 37/86 |
| 4,833,797 | 5/1989 | Slunecka et al. | 37/86 |
| 4,974,348 | 12/1990 | Wallace | 37/86 |
| 5,056,244 | 10/1991 | Bryan, Jr. | 37/191 A |

FOREIGN PATENT DOCUMENTS

| | | |
|---|---|---|
| 1484817 | 2/1969 | Fed. Rep. of Germany . |
| 56175259 | 5/1983 | Japan . |

OTHER PUBLICATIONS

"Auburn Gear-Draulic Trencher," Auburn Machine Works, advertising publication.

"Burkeen AF T65 Trenching Attachment," Burkeen, 1120 High Point Cove, Olive Branch, Mississippi, brochure.

Vermeer Trenching Advertisement, Vermeer Manufacturing Co., New Sharon Road, Pella, Iowa, from *Public Works* magazine, Nov., 1991.

Construction Equipment Magazine article, Nov., 1991, p. 61, concerning Melroe Walk-Behind Trencher.

Bradco Trenchers, American Trencher, Inc., P.O. Box 266, Delhi, Iowa, Sales Brochure, Circa 1985; 1988.

Sales Brochure, Circa 1985; 1988.

*Primary Examiner*—Dennis L. Taylor
*Assistant Examiner*—J. Russell McBee
*Attorney, Agent, or Firm*—Leatherwood Walker Todd & Mann

[57] ABSTRACT

A trencher for mounting on a conventional three point hitch of a tractor. The trencher is driven from the power takeoff of the tractor and uses the hydraulic system of the tractor to operate a hydraulic cylinder for raising and lowering the boom and digging chain of the trencher. A power transmission system is provided using interchangeable belts and pulleys for selectively changing drive ratios for driving the digging chain. The boom is telescoping and can be lengthened to achieve a deeper digging depth through turning of an adjustment rod. The boom is spring-loaded for absorbing shocks delivered by the chain to the boom.

16 Claims, 4 Drawing Sheets

Fig. 3
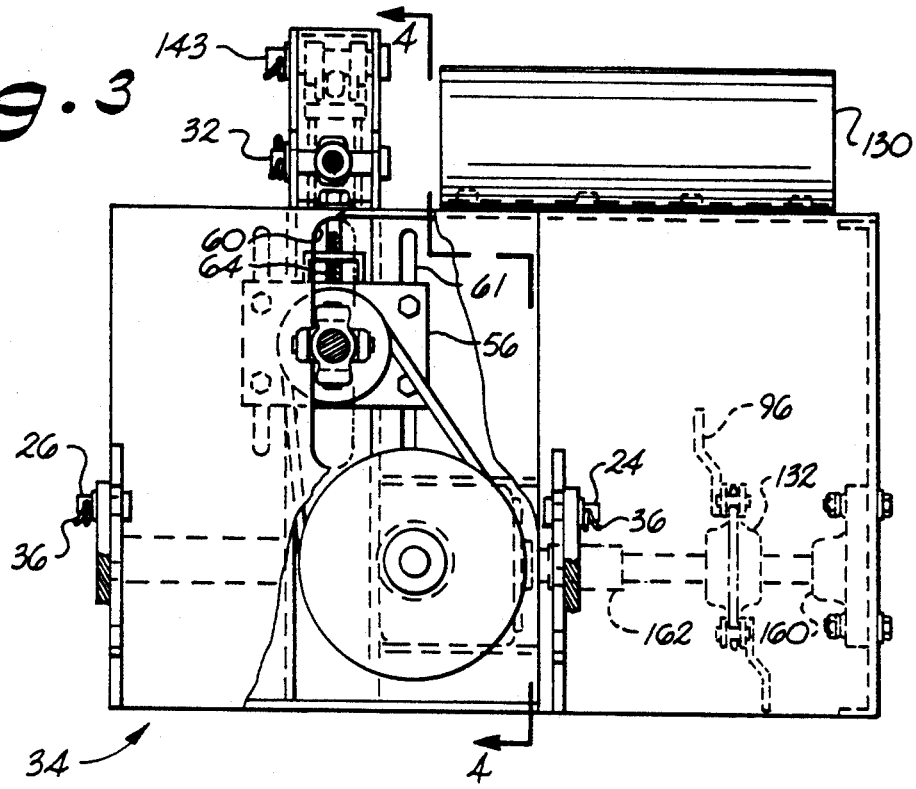
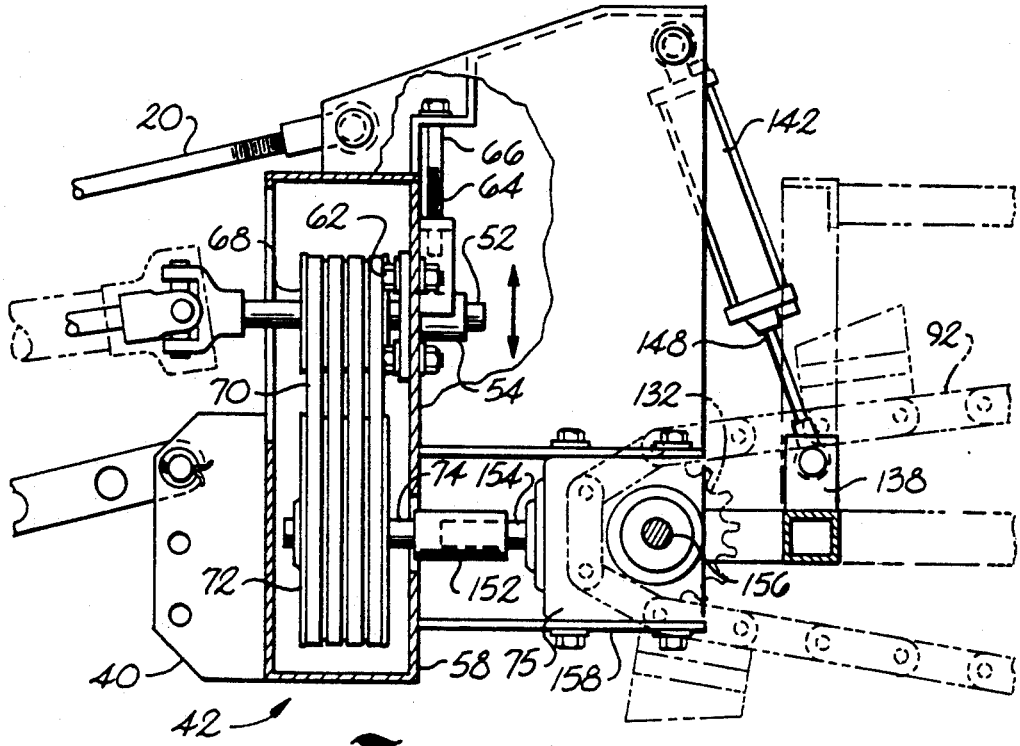
Fig. 4

TRENCHER FOR MOUNTING ON A TRACTOR

BACKGROUND OF THE INVENTION

This invention relates generally to a trenching apparatus which can be mounted on a conventional tractor.

Powered trenching devices are known. Typically, trenching machines include a boom having a continuous digging chain carried for sliding movement about the boom. Sprockets are provided on the boom for engagingly driving the digging chain in a circuitous path around the length of the boom. At least one of the sprockets is connected to the output of drive means, such as a motor or engine.

In use, the boom is forced downwardly into the ground while the digging chain is moving. The digging chain has teeth which break up and lift soil from below ground level above ground level, where the teeth deposit the soil on either side of the trench being dug. When the boom is forced downwardly such that the tip of the boom is at the desired depth of the trench, the trenching machine eases forward to provide a continuous trench at that depth.

Generally, a trenching device as described above is part of a dedicated trenching machine, such as those disclosed in U.S. Pat. No. 3,623,246, granted to Skomial, et al.; U.S. Pat. No. 3,209,473, granted to Davis; U.S. Pat. No. 3,206,876, granted to Penote, et al.; U.S. Pat. No. 3,050,881, granted to Brown; U.S. Pat. No. 2,981,012, granted to Meyer; and U.S. Pat. No. 2,935,801, granted to Stewart, et al. Dedicated trenching machines are by their very nature limited in versatility for uses other than trenching.

Where a trencher is needed on an occasional basis by, for example, a contractor or individual, for digging narrow trenches, a trencher which could be attached to a conventional tractor would be particularly desirable. Such trenchers would be particularly useful for digging trenches for laying cable and piping. However, such trenchers typically have relatively large power requirements, which limit the type of tractor on which they can be mounted, with a tractor having at least 40 horsepower generally being required.

U.S. Pat. No. 3,130,506, granted to Laster, discloses a trenching device which can be used on a tractor. U.S. Pat. No. 3,834,049, issued to Bond and German Patent No. 1,484,817 also disclose trenching devices for mounting on a tractor. Other tractor-mounted trenchers are manufactured by American Trencher, Inc., of Delhi, Iowa and by Burkeen, of Olive Branch, Miss.

A common problem with tractor mounted trenchers is that in order for the trencher to operate properly, the tractor must have a relatively large horsepower engine. Also, the tractor is sometimes required to have a hydrostatic drive or an exceptionally low drive gear, known as a "creeper" gear, which generally adds considerably to the cost of the tractor. Further, to increase the digging depth of the trencher, a costly extension is generally needed for the boom.

SUMMARY OF THE INVENTION

It is therefore an object of the present invention to provide a trenching device which can be readily attached to or removed from a conventional tractor.

Another object of the present invention is to provide a tractor-mounted trencher having means for readily extending or shortening the length of a digging boom.

Another object of the present invention is to provide a tractor-mounted trencher having shock absorbing means built into the boom which reduce shock forces developed from the digging chain from being transferred to the trencher drive mechanism.

Another object of the present invention is to provide a tractor-mounted trencher which is connectable to a conventional three-point hitch of a tractor.

Yet another object of the present invention is to provide a tractor-mounted trencher which is driven by a conventional power takeoff shaft of a tractor.

Still another object of the present invention is to provide a tractor-mounted trencher having a boom which is raised and lowered with respect to the three-point hitch of the tractor.

And still another object of the present invention is to provide a tractor-mounted trencher having hydraulic means for raising and lowering the digging boom and which are connectable to a conventional hydraulic system of a tractor.

Finally, another object of the present invention is to provide a tractor-mounted trencher having means for readily changing the drive ratio between the power takeoff shaft of the tractor and the digging chain.

Generally, in one embodiment of the present invention, a trenching apparatus is disclosed for use on a tractor having a three point hitch, the three point hitch having an upper hitch member and first and second lower hitch arms spaced apart from one another. The tractor has hydraulic means connected to the three point hitch for selectively raising and lowering the three point hitch, and the tractor includes a rotatable power takeoff device for selectively delivering a rotational power output. The power takeoff device has at least one rotatable drive member for delivering rotational power.

In particular, the trenching apparatus includes a trencher support structure connectable to the three point hitch of the tractor. The trencher support structure includes first and second hitch members connectable to the first and second lower hitch arms of the tractor, respectively, and an upper hitch member connectable to the upper hitch member.

An elongated boom is pivotally connected to the trencher support frame, the boom having an elongated inner sleeve and an elongated outer sleeve. The inner sleeve is carried in the outer sleeve for telescoping movement relative thereto. A spring biasing device is connected to the boom for biasing the inner sleeve outwardly from the outer sleeve. Boom extension means are connected to the boom for allowing selective fixed extension of the inner sleeve with respect to the outer sleeve.

Power transmission means are connected to the trencher support structure and are connectable with the rotatable drive member, the power transmission means being for translation of the rotational power output from the power takeoff means to a drive output.

At least one digging chain is carried by the boom for movement with respect to the boom, the digging chain being connected to the drive output of the power transmission means for movement about the length of the boom for digging a trench in the ground.

More specifically, the boom extension means includes a threaded boom extension member connected to the outer sleeve of the boom and received by the inner sleeve for sliding movement relative thereto. The boom extension means includes a pressure surface carried for sliding movement in the outer sleeve which is in threaded engagement with the threaded boom extension member.

The spring biasing means includes a coil spring carried in the outer sleeve for contacting the pressure surface and for contacting the inner sleeve, such that upon selective rotation of the boom extension member, the pressure surface contacts the coil spring, and acting through the coil spring, forces the inner sleeve outwardly from the outer sleeve, thereby lengthening the boom.

BRIEF DESCRIPTION OF THE DRAWINGS

The foregoing as well as other objects of the present invention will be more apparent from the following detailed description of the preferred embodiment of the invention, when taken together with the accompanying drawings, in which:

FIG. 3 is a sectional view along lines 3—3 of FIG. 2, with parts cut away, of a tractor-mounted trencher constructed in accordance with the present invention;

FIG. 4 is a sectional view along lines 4—4 of FIG. 3, with parts cut away, of a tractor-mounted trencher constructed in accordance with the present invention;

DESCRIPTION OF THE PREFERRED EMBODIMENT

The present invention is related to a trenching device disclosed by the present applicant in U.S. patent application Ser. No. 07/031,990, entitled, "Tractor-Mounted Trenching Apparatus," filed Mar. 27, 1987 now abandoned, such application being incorporated herein in its entirety by reference thereto.

Figure 1:
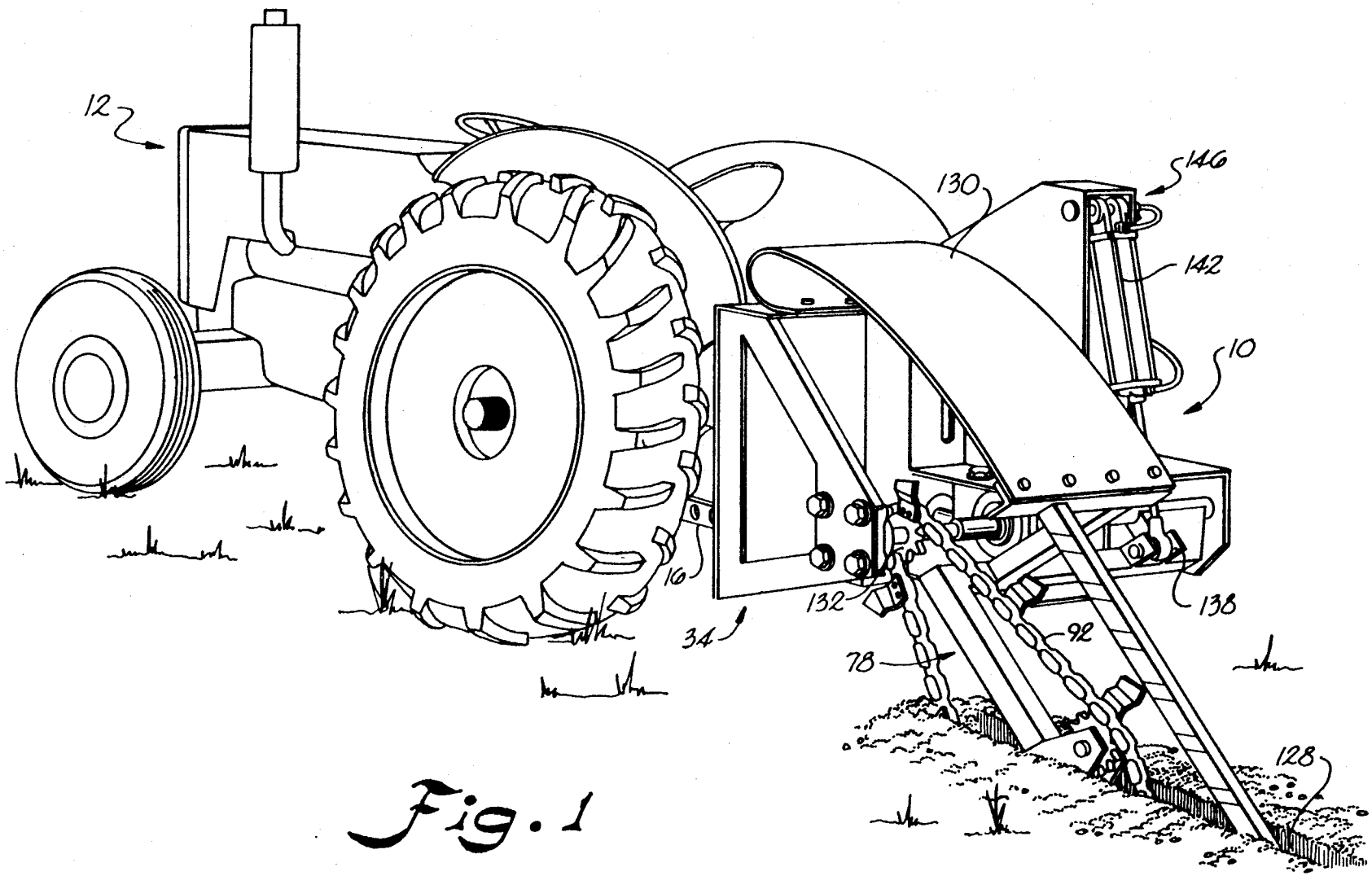
FIG. 1 is a perspective view of a trenching apparatus constructed in accordance with the present invention mounted on a conventional tractor.

Referring to the drawings in detail, wherein like reference characters represent like elements throughout the various views, a tractor-mounted trencher constructed in accordance with the present invention is designated generally as 10 in FIG. 1.

Turning to FIG. 1 of the drawings, tractor-mounted trencher 10 is illustrated in an operational configuration attached to a tractor, generally 12. As can be seen from FIGS. 1 and 2, tractor 12 includes a three-point hitch, generally 14, which has first and second lower hitch arms 16 and 18 spaced apart from one another and also an upper hitch member 20 spaced above lower hitch arms 16, 18. The configuration of three-point hitch 14 is of conventional design and is commonly found on present day tractors. Three-point hitch 14 is generally of standardized dimensions such that a variety of implements available on the market can be attached to it. As can be seen from FIG. 2, lower hitch arms 16, 18 include a series of openings 22 for receipt of standardized pins 24, 26 commonly found on farm and machine implements. Openings 22 allow for adjustment of trencher 10 or another implement at various positions with respect to arms 16, 18. Also, upper hitch member 20 includes a turnbuckle 28 which can be used to adjust the position of the implement, such as trencher 10, with respect to tractor 12. Upper hitch member 20 is attached to a pin 30 on tractor 12 and also to an upper hitch means, or pin, 32 on the trencher support structure, generally 34, of trencher 10. As shown in FIG. 3, first and second hitch means, or pins, 24, 26 are also disposed on support structure 34 in a substantially colinear, spaced apart, relationship. Hitch pins, or clips, 36 are provided on pins 24, 26 for retaining support structure 34 between arms 16, 18. Hitch 14 preferably is of the type which can be selectively raised and lowered through use of a conventional hydraulic system on tractor 12.

Trencher support structure 34 also includes the hitch means having substantially vertically extending plates 38 having a plurality of hitch member openings 40 for receipt of pins 24, 26. Hitch member openings 40 allow for further adjustment of trencher 10 with respect to three-point hitch 14 of tractor 12, in that pins 24, 26 can be inserted in different hitch member openings 40 depending on the depth and/or angle of the trench being dug.

Attached to trencher support structure 34 are power transmission means, which include a box-shaped power transmission housing 42, which is connectable with a conventional power takeoff ("PTO") 44 of a tractor. PTO 44 is driven by the tractor's engine and is selectively engaged or disengaged by means of a lever, switch, or other control device by the operator of the tractor. PTO 44 includes a splined rotatable drive shaft 46 which is connected to a telescoping coupler 48. Coupler 48 includes universal joints 50 at both ends thereof, with one end being connected to the PTO drive shaft 46, and the other end being attached a first, or upper, spindle 52 rotatably supported in power transmission housing 42.

As seen in FIGS. 3 and 4, upper spindle 52 is supported in a spindle housing 54 for rotation therein. Spindle housing 54 preferably includes conventional bearing means for facilitating the rotation of upper spindle 52. A bracket 56 is attached to spindle housing 54 and attaches spindle housing 54 to rear wall 58 of power transmission housing 42. Spindle adjustment tracks 60, 61 are provided for receiving and for allowing vertical movement of upper spindle 52 and bolts 62, which attach bracket 56 to rear wall 58, respectively. A threaded adjustment member, or bolt, 64 is threadingly received by bracket 56. Adjustment bolt 64 also includes a smooth shoulder 66 which is received in a bore provided in trencher support structure 34. By turning of adjustment bolt 64, bracket 56 can be selectively moved up and down within track 60 to allow for relative displacement between first, or upper, spindle pulleys 68 which are fixedly attached to spindle 52 for rotation therewith. Upper spindle pulleys 68 drivingly engage belts 70, which in turn drivingly engage second, or lower, spindle pulleys 72. Lower spindles 72 are fixedly attached to a second, or lower, spindle 74, which is supported for rotation and connected to a gearbox 75, discussed in more detail below.

Through adjustment of upper spindle 52, by means of adjustment bolt 64, upper pulleys 68 can be selectively moved towards or away from lower spindle pulleys 72 to accommodate belts 72 of different lengths or to accommodate pulleys of different sizes. Driving of lower spindle 74 by means of pulleys 68, 72 and belts 70 provide several advantages to trencher 10. For example, pulleys 68, 72 are allowed to slip with respect to one another and belts 70 in the event that the boom 78 encounters a buried obstacle, such as a rock, pipe, root, or other object. While allowing pulleys 68, 70 to slip with respect to one another and with respect to belts 70, transmission of harmful shock forces during digging to the drive system of trencher 10 are minimized. Further, alignment between pulleys 68, 72 and belts 70 is not as critical as would be the case with other drive systems, such as those using sprockets and chains.

The drive ratio of upper spindle 52 with respect to lower spindle 74 can readily be changed by simply interchanging pulleys 72, 68 with one another, since upper and lower spindles 52, 74 are preferably of the same diameter. Or, other combinations of different pulley sizes could be used, if desired, to achieve a specific drive ratio between spindles 52, 74. Through allowing the drive ratio between PTO 44 and spindle 74 (and ultimately digging chain 92) to be varied with respect to one another by simply providing pulleys 68, 72 of specific pre-determined diameters, trencher 10 can accommodate the standard low, or first, gear moving speed of a wide range of tractors. Thus, a tractor with a hydrostatic drive or a creeper gear is not required for trencher 10. With the standard first gear moving speed and the available horsepower of a particular tractor to which trencher 10 is to be attached being known, the required diameters of pulleys 68, 72 can be readily determined such that trencher 10 will operate properly in digging trenches. Pulleys 68, 72 use connection means such as keys and keyways for attachment on spindles 52, 74 and are also bolted to those spindles, respectively.

By providing the belt and pulley drive system, and the adjustability feature of upper spindle housing 54, a wide range of drive ratios between the PTO 44 of tractor 12 and that of the digging chain of boom 78 can be achieved. This also allows for a tractor having as little as 12 horsepower to be used with trencher 10.

Figure 2:
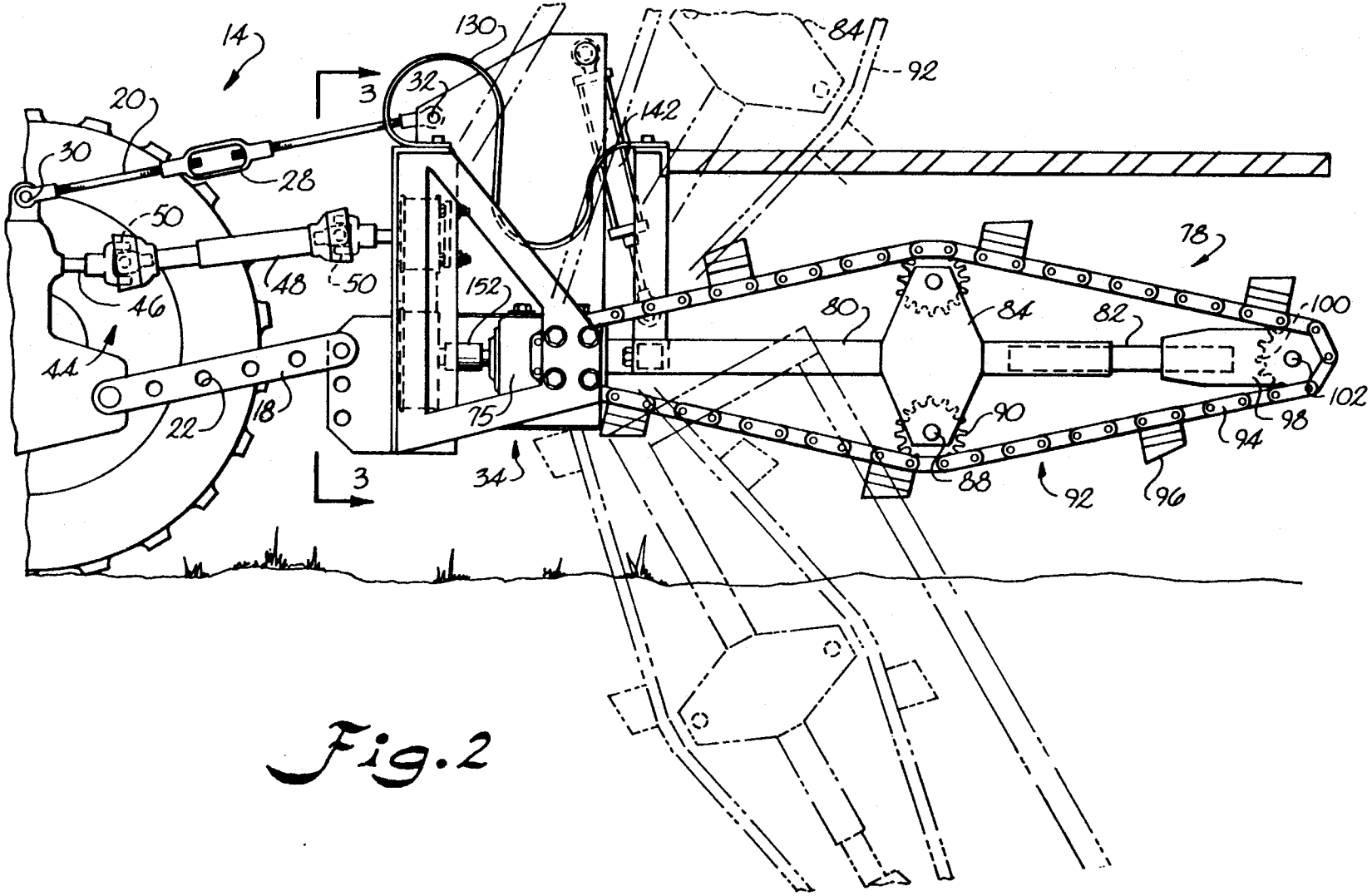
FIG. 2 is a partial side elevational view of a tractor-mounted trencher constructed in accordance with the present invention.
Figure 5:
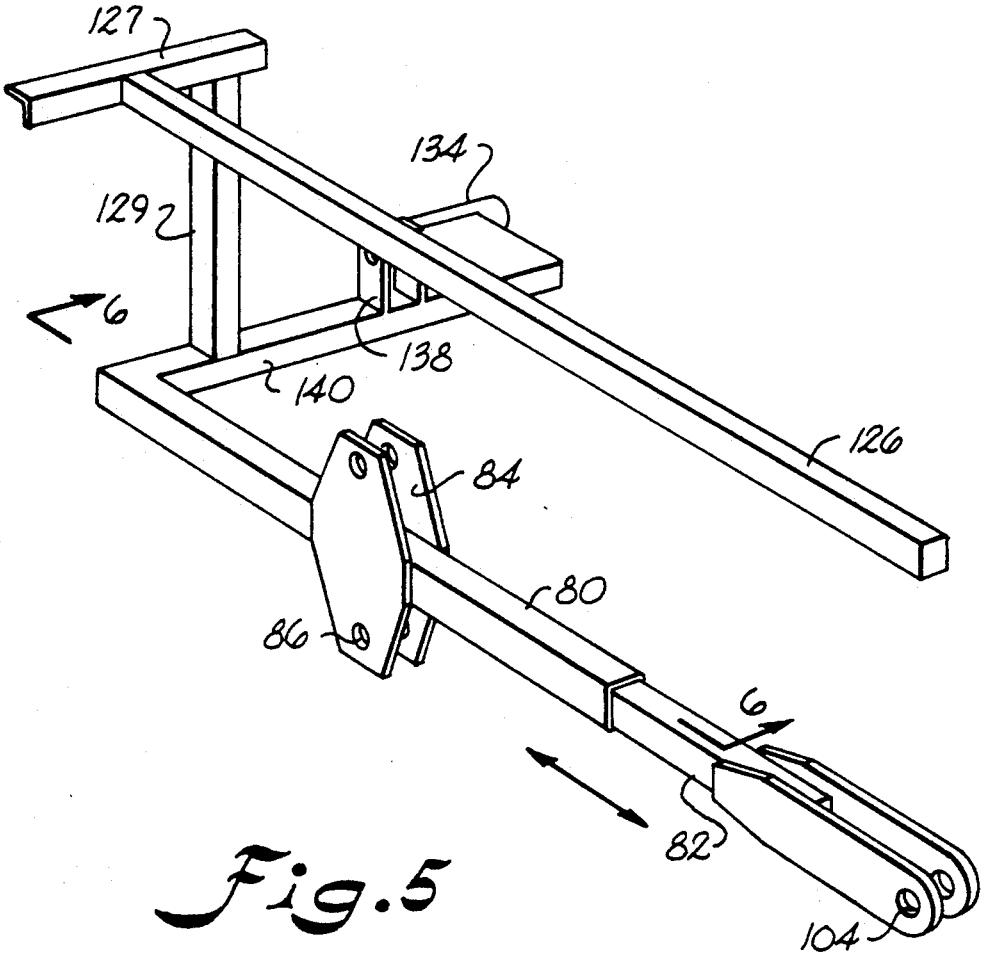
FIG. 5 is a partial perspective view of a tractor-mounted trencher constructed in accordance with the present invention.
Figure 6:
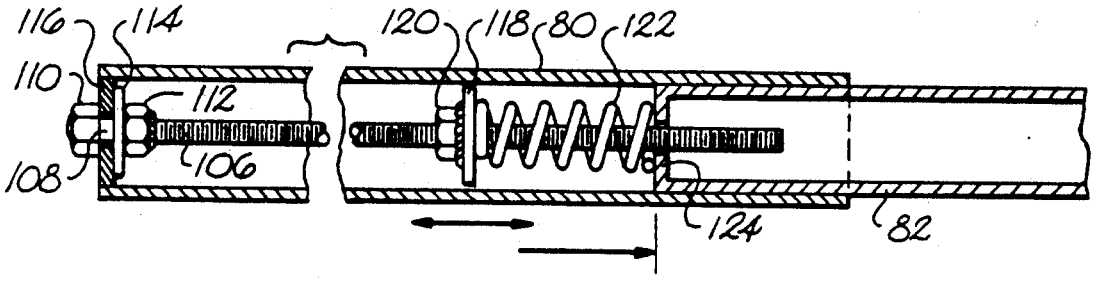
FIG. 6 is a sectional view along lines 6—6 of FIG. 5, with parts cut away, of an extendable boom constructed in accordance with the present invention.

FIGS. 2, 5, and 6 illustrate in detail a boom assembly generally 78, which is attached to trencher support frame 34 for pivotal movement with respect to frame 34. As illustrated in FIG. 5, boom 78 includes an elongated outer sleeve 80 of substantially rectangular or square cross-section. Received within outer sleeve 80 for telescopic movement relative to sleeve 80 is an inner sleeve 82, also being of a substantially rectangular or square cross-section. Connected to outer surfaces of outer sleeve 80, at approximately a mid-portion thereof, are sprocket support mounting plates 84 having openings 86 for receiving the shafts 88 of sprockets 90. Sprockets 90 engage a conventional digging chain, generally 92, which includes driving links 94 and scalloped digging flanges 96 spaced apart from one another along digging chain 92.

Inner sleeve 82 includes end sprocket mounting plates 98 extending outwardly from sleeve 82 for carrying an end sprocket 100. The shaft 102 of end sprocket 100 is received within openings 104 of end sprocket mounting plates 98. It is understood that bearings could be provided in the openings of mounting plates 84, 98 for engaging the shafts of the sprockets, if desired.

As stated above, inner sleeve 82 is carried for sliding, telescopic movement within outer sleeve 80. Means for shortening or extending the length of boom 78 are illustrated in FIG. 6. As shown in that figure, a threaded boom adjustment member, or rod, 106 is disposed within boom 78. Threaded rod 106 is received within a smooth bore 108 of outer sleeve 80. A nut 110 is welded to rod 106 and is external to outer sleeve 80. Rod 106 also includes an additional nut 112 welded thereto inside of outer sleeve 80. A washer 114 is provided between nut 12 and an end cap 116 of outer sleeve 80. Also disposed within outer sleeve 80 is pressure surface, or an engagement member, 118 to which a threaded nut 120 is welded. Nut 120 is in threaded engagement with rod 106, such that upon turning of rod 106, nut 120 causes engagement member 118 to move linearly within outer sleeve 80. Contacting engagement member 188 is a coil spring 122, which also engages an end cap 24 of inner sleeve 82. Contact or coil spring 122 with engagement member 118 and end cap 124 forces inner sleeve 82 outwardly from outer sleeve 80, thereby effectively shortening or lengthening boom 78 through the selective turning of nut 110 as desired.

The ability to selectively lengthen boom 78 through turning of rod 106, provides several advantages. First, slack in digging chain 92 can be eliminated by lengthening the boom through rotation of rod 106. Second, not only can the slack be taken up in digging chain 92, the effective digging length of boom 78 can be increased through rotation of rod 106, without the need of adding additional boom extender devices, and without the need of removing digging chain 92 from the boom 78. FIG. 6 illustrates in a fragmented view the length of rod 106, but in the preferred embodiment, rod 106 is long enough to significantly increase the digging length of the boom, to the point where additional links would be required in digging chain 92 to accommodate the extended boom length. Also, by placing spring 102 and rod 106 within boom 78, such do not interfere with the digging action of boom 78 and chain 92.

Coil spring 102 biases inner sleeve 82 outwardly from outer sleeve 80 to maintain tension in digging chain 92, but also, to act as a shock absorber during trenching to reduce transmission of forces developed from jerking and erratic movements of the digging chain to the gear box 75, particularly in the event digging chain 92 encounters a buried obstacle. In combination with the belt 70 and pulley 68, 72 drive discussed above, coil spring 122, the transmission of damaging forces from the chain to the power transmission of trencher 10 and the power takeoff of tractor 12, is significantly minimized.

Boom 78 is also provided with a boom location and guard device 126. Boom locator 126 is connected to bar 127, which is attached to upright 129, and extends substantially the length of boom 78 and follows boom 78 downwardly into a trench 128 being dug. Boom locator 126 allows for an operator on tractor 12 to visually note the position and depth relationship of boom 78 within trench 128. More importantly, boom locator 126 acts as a guard to prevent objects from falling onto digging chain 92 when trencher 10 is in use, and also to prevent workers, tools, and other objects from contacting digging chain 92 from above when in operation.

A further safety feature is a power transmission enclosure member 130, which is attached to boom 78 and support frame 34. Enclosure member 130 acts as a further guard to prevent outside contact of personnel, tools, or other objects with drive sprocket 132 and digging chain 92. Enclosure member 130 is preferably constructed of rubber, coated fabric, plastic, or other flexible material so that it may freely conform to the movement of boom 78 while providing protection against objects contacting drive sprocket 132 and digging chain 92.

Boom 78 is connected to support structure 34 by means of a journal 134, which is attached to boom 78. Journal 134 receives a shaft (not shown) which is connected to support structure 34. Journal 134 is pivotable about the shaft, such that boom 78 is pivotal with respect to support structure 34. A positioning bracket 138 is also attached to cross member 140 of boom 78 and receives a pivotal connector of a double action hydraulic piston/cylinder unit 142. Piston/cylinder unit 142 is pivotally connected by means of a pivotal connector 143 to an upper portion of tower housing, generally 146, of support structure 134. Rod 148 is pivotally connected to bracket 138 such that upon actuation of piston/cylinder unit 142, boom 78 can be selectively raised and lowered by an operator of tractor 12. This is possible because piston/cylinder 142 is connected to a conventional hydraulic system (not shown) of tractor 12. It is to be understood that piston/cylinder unit 142 could also be pneumatically actuated, or an electrical device, such as a motor and screw arrangement, or a motor and rack and pinion arrangement, could be used to raise and lower boom 78 in place of the hydraulic cylinder 142, if desired. Thus, boom 78 is raised and lowered by piston/cylinder unit 142 independently of the raising and lowering of the tractor's three-point hitch 14.

A gear reduction box 75, is connected to lower spindle 74 by means of a conventional shaft coupling 152. Gear reduction box 75 includes an input shaft 154 and an output shaft 156, which extend substantially perpendicular with respect to one another. The rotational input of input shaft 154 is reduced by gear box 72 such that output shaft 156 rotates at a slower rotational velocity, but at a higher rate of torque than input shaft 154. The higher torque of output shaft 156, which is fixedly connected to drive sprocket 132, allows for enhanced digging capacity of digging chain 92. Gear box 75 is received within a substantially rectangular power transfer compartment 158 connected to power transmission housing 152.

In use, trencher 10 is connected to three-point hitch 14 of tractor 12 through use of hitch pins 24, 26 and upper hitch coupling 32, and drive coupler 48 is connected to the PTO shaft 44 of tractor 12. Hitch is lowered using the tractor's hydraulic system to position trencher 14 near the surface of the ground. The PTO system of tractor 12 is activated, such that upper spindle 52 drives lower spindle 74 through engagement of belts 70 with pulleys 68, 72. Spindle 74 drives input shaft 154 of gear box 75, which in turn drives output shaft 156. Output shaft 156, which is supported for rotation by bearings 160, 162 attached to support structure 34, rotates drive sprocket 132, which drives digging chain 92 about boom 78. Hydraulic cylinder 142 is activated using the hydraulic control system of tractor 12 to lower boom 78 to a digging depth.

In the event the digging depth needs to be increased, additional lengths are added into chain 92, and threaded rod 106 is advanced to force inner sleeve 82 outwardly to take up the slack in chain 92 created through the addition of new lengths. If the need arises to shorten the boom, for example if a link breaks in digging chain 92, threaded rod 106 is rotated in the opposite direction, causing inner sleeve 82 to retract into outer sleeve 80, thereby shortening boom 78.

Trencher 10 is sized accordingly to be attached to a conventional three point hitch 14. Because of this design, trencher 10 can be quickly and easily connected to a wide variety of conventional tractors when a trenching capability is desired. After a trenching operation is completed or whenever desired, trencher 10 can be quickly and easily removed from tractor 12 in a reverse manner, thereby allowing tractor 12 to be used for operations other than trenching, such as for earth moving, mowing, plowing, spraying, fertilizing and the like. Connection of trencher 10 to power take-off shaft 46 of tractor 12 is done in a conventional manner similarly as is the connection of power take-off shaft 46 to other mechanized implements.

Boom 78 of trenching apparatus 10 is movable between a retracted position, as shown in phantom in FIG. 2, and a trenching position by piston/cylinder unit 142. The entire trencher 10 can be raised and lowered by actuating the hydraulic system of the tractor to move three point hitch 14 upwards or downwards.

While a preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art without departing from the spirit or scope or the following claims.

What is claimed is:

1. A trenching apparatus for use on a tractor having a three point hitch, the three point hitch having first and second lower hitch arms spaced apart from one another and an upper hitch member; the tractor having hydraulic means connected to the three point hitch for selectively raising and lowering the three point hitch; the tractor including rotatable power takeoff means for selectively delivering a rotational power output, the power takeoff means having at least one rotatable drive member for delivering rotational power, the trenching apparatus including:

a trencher support structure connectable to the three point hitch of the tractor; said trencher support structure including first and second hitch members connectable to said first and second lower hitch arms of the tractor, respectively, and upper hitch means connectable to the upper hitch member;

an elongated boom pivotally connected to said trencher support frame; said boom having an elongated inner sleeve and an elongated outer sleeve, said inner sleeve being carried in said outer sleeve for telescoping movement relative thereto;

spring biasing means connected to said boom for biasing said inner sleeve outwardly from said outer sleeve;

boom extension means carried in said boom for allowing selective fixed extension of said inner sleeve with respect to said outer sleeve;

power transmission means connected to said trencher support structure and connectable with the rotatable drive member; said power transmission means being for translation of the rotational power output from the power takeoff means to a drive output; and at least one digging chain carried by said boom for movement with respect to said boom, said digging chain being connected to the drive output of said power transmission means for movement about the length of said boom for digging a trench in the ground.

2. A trenching apparatus as defined in claim 1, wherein said power transmission means comprises:

a power transmission housing;

a first spindle carried for rotation in said power transmission housing;

at least one first spindle pulley fixedly attached to said first spindle for rotation therewith;

a second spindle carried for rotation in said power transmission housing;

at least one second spindle pulley fixedly attached to said second pulley for rotation therewith;

at least one drive belt engaging said first and second spindle pulleys; and connection means for connecting said first spindle to the rotational drive member of the power takeoff means.

3. A trenching apparatus as defined in claim 2, further comprising first spindle adjustment means connected to said first spindle for selectively adjusting said first spindle with respect to said second spindle to allow said power transmission means to accommodate a variety of lengths of said drive belt; said first spindle adjustment means including a spindle housing rotatably supporting said first spindle; said power transmission housing defining a spindle adjustment track for carrying said spindle housing for movement therein; and an adjustment member connected to said spindle housing for selectively moving said spindle housing within said spindle adjustment track, thereby selectively varying the distance between said first spindle pulley and said second spindle pulley.

4. A trenching apparatus as defined in claim 1, further comprising hydraulic actuation means connected to said trencher support structure and said boom for selectively pivoting said boom with respect to said trencher support structure.

5. A trenching apparatus as defined in claim 1, wherein:

said boom extension means includes a threaded boom extension member connected to said outer sleeve and being received by said inner sleeve for sliding movement relative thereto; said boom extension means including a pressure surface carried for sliding movement in said outer sleeve and in threaded engagement with said threaded boom extension member; and said spring biasing means includes a coil spring carried in said outer sleeve for contacting said pressure surface and for contacting said inner sleeve, such that upon selective rotation of said boom extension member, said pressure surface contacts said coil spring, and acting through said coil spring, forces said inner sleeve outwardly from said inner sleeve, thereby lengthening said boom.

6. A trenching apparatus for use on a tractor having a three point hitch, the three point hitch having first and second lower hitch arms spaced apart from one another and an upper hitch member; the tractor having hydraulic means connected to the three point hitch for selectively raising and lowering the three point hitch; the tractor including rotatable power takeoff means for selectively delivering a rotational power output, the power takeoff means having at least one rotatable drive member for delivering rotational power, the trenching apparatus including:

a trencher support structure connectable to the three point hitch of the tractor; said trencher support structure including first and second hitch means connectable to said first and second lower hitch arms of the tractor, respectively and upper hitch means connectable to the upper hitch member;

an elongated boom pivotally connected to said trencher support structure; said boom having an elongated inner sleeve and an elongated outer sleeve, said inner sleeve being carried in said outer sleeve for telescoping movement relative thereto;

spring biasing means connected to said boom for biasing said inner sleeve outwardly from said outer sleeve; said spring biasing means including a spring carried in said outer sleeve for contacting a pressure surface and for contacting said inner sleeve;

boom extension means connected to said boom for allowing selective fixed extension of said inner sleeve with respect to said outer sleeve; said boom extension means including a threaded boom extension member connected to said outer sleeve and being received by said inner sleeve for sliding movement relative thereto; said boom extension means having a pressure surface carried for sliding movement in said outer sleeve and in threaded engagement with said threaded boom extension member, such that upon selective rotation of said boom extension member, said pressure surface contacts said coil spring, and acting through said coil spring, forces said inner sleeve outwardly from said inner sleeve, thereby lengthening said boom;

power transmission means connected to said trencher support structure and connectable with the rotatable drive member; said power transmission means being for translation of the rotational power output from the power takeoff means to a drive output; said power transmission means comprising a power transmission housing; a first spindle carried for rotation in said power transmission housing; at least one first spindle pulley fixedly attached to said first spindle for rotation therewith; a second spindle carried for rotation in said power transmission housing; at least one second spindle pulley fixedly attached to said second pulley for rotation therewith; at least one drive belt engaging said first and second spindle pulleys; and connection means for connecting said first spindle to said rotational drive member of said power takeoff means;

first spindle adjustment means connected to said first spindle for selectively adjusting said first spindle with respect to said second spindle to allow said power transmission means to accommodate a variety of lengths of said drive belt; said first spindle adjustment means including a spindle housing rotatably supporting said first spindle; said power transmission housing defining a spindle adjustment track for carrying said spindle housing for movement therein; and an adjustment member connected to said spindle housing for selectively moving said spindle housing within said spindle adjustment track, thereby selectively varying the distance between said first spindle pulley and said second spindle pulley; and at least one digging chain carried by said boom for movement with respect to said boom, said digging chain being connected to the drive output of the said power transmission means for movement about the length of said boom for digging a trench in the ground.

7. A trenching apparatus as defined in claim 6, wherein said adjustment member is a threaded bolt.

8. A trenching apparatus, comprising;

a tractor having a three point hitch; said three point hitch having first and second lower hitch arms spaced apart from one another and an upper hitch member; said tractor having means connected to said three point hitch for selectively raising and lowering said three point hitch; said tractor including rotatable power takeoff means for selectively delivering a rotational power output, said power takeoff means having at least one rotatable drive member for delivering rotational power;

a trencher support structure connectable to said three point hitch of said tractor; said trencher support structure including first and second hitch members connectable to said first and second lower hitch arms, respectively, and upper hitch means connectable to said upper hitch member;

an elongated boom pivotally connected to said trencher support frame; said boom having an elongated inner sleeve and an elongated outer sleeve, said inner sleeve being carried in said outer sleeve for telescoping movement relative thereto;

spring biasing means connected to said boom for biasing said inner sleeve outwardly from said outer sleeve;

boom extension means connected to said boom for allowing selective fixed extension or said inner sleeve with respect to said outer sleeve;

power transmission means connected to said trencher support structure and connectable with said rotatable drive member; said power transmission means being for translation of said rotational power output from said power takeoff means to a drive output; and at least one digging chain carried by said boom for movement with respect to said boom, said digging chain being connected to said drive output of said power transmission means for movement about the length of said boom for digging a trench in the ground.

9. A trenching apparatus as defined in claim 8, wherein said power transmission means comprises:

a power transmission housing;

a first spindle carried for rotation in said power transmission housing;

at least one first spindle pulley fixedly attached to said first spindle for rotation therewith, said first spindle pulley being of a first driving diameter;

a second spindle carried for rotation in said power transmission housing;

at least one second spindle pulley fixedly attached to said second pulley for rotation therewith said second spindle pulley being of a second driving diameter;

at least one drive belt engaging said first and second spindle pulleys; and connection means for connecting said first spindle to said rotational drive member of said power takeoff means.

10. A trenching apparatus as defined in claim 9, further comprising first spindle adjustment means connected to said first spindle for selectively adjusring said first spindle with respect to said second spindle to allow said power transmission means to accommodate a variety of lengths of said drive belt; said first spindle adjustment means including a spindle housing rotatably supporting said first spindle; said power transmission housing defining a spindle adjustment track for carrying said spindle housing for movement therein; and an adjustment member connected to said spindle housing for selectively moving said spindle housing within said spindle adjustment track, thereby selectively varying the distance between said first spindle pulley and said second spindle pulley.

11. A trenching apparatus as defined in claim 10, wherein said first and second spindle pulleys are of different diameters with respect to one another.

12. A trenching apparatus as defined in claim 9, wherein said first and second driving diameters are substantially the same thereby allowing said first spindle pulley to be drivingly attached to said second spindle and said second spindle pulley to be drivingly attached to said first spindle.

13. A trenching apparatus as defined in claim 8, further comprising an elongated boom locating device connected to said trencher support structure, said boom locating device being spaced above said boom and extending substantally the length of said boom.

14. A trenching apparatus as defined in claim 8, further comprising a flexible power transmission enclosure member associated with said power transmission housing for covering said drive output of said power transmission means and for covering exposed portions of said digging chain during trench digging.

15. A trenching apparatus as defined in claim 8, wherein said power transmission means includes a gear reduction box having a rotatable input member and a rotatable output member; and said rotatable input and output members being disposed substantially perpendicularly with respect to one another.

16. A trenching apparatus as defined in claim 8, wherein:

said boom extension means includes a threaded boom extension member connected to said outer sleeve and being received by said inner sleeve for sliding movement relative thereto; said boom extension means including a pressure surface carried for sliding movement in said outer sleeve and in threaded engagement with said threaded boom extension member; and said spring biasing means includes a coil spring carried in said outer sleeve for contacting said pressure surface and for contacting said inner sleeve, such that upon selective rotation of said boom extension member, said pressure surface contacts said coil spring, and acting through said coil spring, forces said inner sleeve outwardly from said inner sleeve, thereby lengthening said boom.

* * * * *